US005139916A

United States Patent [19]

Ciccarelli

[11] Patent Number: 5,139,916

[45] Date of Patent: Aug. 18, 1992

[54] PROCESSES FOR THE PREPARATION OF TONER COMPOSITIONS

[75] Inventor: Roger N. Ciccarelli, Rochester, N.Y.

[73] Assignee: Xerox Corporation, Stamford, Conn.

[21] Appl. No.: 730,414

[22] Filed: Jul. 16, 1991

Related U.S. Application Data

[62] Division of Ser. No. 288,196, Dec. 22, 1988, abandoned.

[51] Int. Cl.[5] ..... G03G 9/09; G03G 9/087

[52] U.S. Cl. ..... 430/137

[58] Field of Search ..... 430/137

[56] References Cited

U.S. PATENT DOCUMENTS 4,727,011 2/1988 Mahabadi et al. ..... 430/138
4,764,447 8/1988 Tsubuko et al. ..... 430/114 X
4,855,207 8/1989 Tsubuko et al. ..... 430/109

*Primary Examiner*—Roland Martin
*Attorney, Agent, or Firm*—E. O. Palazzo

[57] ABSTRACT

A process for the preparation of toner compositions which comprises forming and organic phase comprised of polymer and solvent, forming an aqueous phase comprised of water and pigment, and flushing the pigment into the organic phase followed by dilution.

27 Claims, No Drawings

PROCESSES FOR THE PREPARATION OF TONER COMPOSITIONS

This is a division, of application Ser. No. 288,196, filed Dec. 22, 1988, now abandoned.

BACKGROUND OF THE INVENTION

This invention is generally directed to the preparation of toner and developer compositions, and more specifically the present invention is directed to processes for obtaining toner compositions, including magnetic, single component, and colored toner compositions by flushing wherein, for example, water wetted magnetite is mixed with a polymer toner resin and solvent for the polymer thereby permitting effective dispersion of the magnetite and allowing the magnetite to be in contact with the toner resin. In one embodiment of the present invention, the toner compositions are prepared by surrounding the magnetite surface by flushing with a toner polymer resin to assure complete and intimate wetting of the magnetite by the polymer, and permanent association of the magnetite with the polymer. Thus, with the process of the present invention the magnetite is properly dispersed in the polymer selected, and the magnetite is in permanent contact with the polymer thereby, for example, avoiding undesirable toner depositions on the imaging member or photoconductor. Also, with the process of the present invention the toner compositions obtained when selected for electrophotographic, and especially xerographic imaging processes, substantially avoid the embedding of magnetite into the imaging member, which can cause undesirable comets to form thereon. Further, with the toner compositions prepared in accordance with the process of the present invention image defects in the final developer are avoided. Moreover, with the toner and developer compositions obtained by the processes of the present invention there is enabled a photoconductive imaging member present in an imaging apparatus to function for extended time periods, for example, up to 500,000 cycles while simultaneously preventing the localized accumulation of undesirable toner debris, and comets thereon which can encompass sufficient areas of the photoconductive members; and there is avoided unwanted toner spots on the final developed output copy, or such spots are minimized. Accordingly, there is permitted with the toner compositions obtained by the process of the present invention the elimination, or substantial reduction of undesirable comets and print deletions in electrophotographic imaging and printing devices, and the other advantages indicated herein.

There is disclosed in U.S. Pat. No. 4,601,918 a process for obtaining toner compositions by suspension polymerization wherein, for example, styrene and magnetite are mixed at a high shearing force and at a temperature of 50° C., see Example I. Lauroyl peroxide is then added to the mixture and other components and the polymer resulting is washed and filtered. In U.S. Pat. No. 3,980,488, the disclosure of which is totally incorporated herein by reference, there is illustrated an improved process for conditioning colored organic pigments by partial communication of the crude pigment in an attrition, shear, or impact type mill followed by a further conditioning of the pigment by treating the partially milled pigment with a bleaching agent during a flushing operation to produce a pigmented organic vehicle having a pigment enhanced pigmentary quality, reference for example column 1. In column 2, lines 52, to column 3 of this patent it is indicated that it has been found that partially milled organic pigments can be flushed into an organic vehicle in the presence of a bleaching agent. The process of this patent is particularly described in column 2, line 60, to column 5. Other patents of interest include U.S. Pat. Nos. 4,218,530 and 4,273,848.

Moreover, toner and developer compositions containing charge enhancing additives, especially additives which impart a positive charge to the toner resin, and process for the preparation thereof are well know. Thus, for example, there is described in U.S. Pat. No. 3,893,935 the use of certain quaternary ammonium salts as charge control agents for electrostatic toner compositions. There are also described in U.S. Pat. No. 2,986,521 reversal developer compositions comprised of toner resin particles coated with finely divided colloidal silica. According to the disclosure of this patent, the development of images on negatively charged surfaces is accomplished by applying a developer composition having a positively charged triboelectric relationship with respect to the colloidal silica. Further, there is illustrated in U.S. Pat. No. 4,338,390, the disclosure of which is totally incorporated herein by reference, developer and toner compositions having incorporated therein as charge enhancing additives organic sulfate and sulfonate compositions; and in U.S. Pat. No. 4,298,672, the disclosure of which is totally incorporated herein by reference, positively charged toner compositions containing resin particles and pigment particles, and as a charge enhancing additive alkyl pyridinium compounds, inclusive of cetyl pyridinium chloride. Generally, these toners are prepared by melt mixing followed by mechanical attrition, thus the magnetite if present is not flushed into the polymer; and with the prior art processes air pockets prevent the physical bonding of the magnetite to the toner polymer resin, a disadvantage avoided with the process of the present invention.

There is thus a need for processes for the preparation of toner compositions wherein there results no undesirable toner depositions on the imaging member incorporated into an electrographic imaging or printing apparatus. In addition, there is a need for toner and developer compositions that maintain their triboelectrical characteristics for extended time periods exceeding, for example, 500,000 developed images. Furthermore, there is a need for single component toners, and colored toners that possess many of the aforementioned characteristics. Also, there is a need for toner and developer compositions wherein the magnetite selected as a pigment is in constant contact with the toner polymer, and is permanently associated with the toner polymer preventing its release from said polymer. Also, there is a need for processes for toner compositions wherein the magnetite is properly dispersed therein.

SUMMARY OF THE INVENTION

It is an object of the present invention to provide processes for toner and developer compositions which possess many of the advantages illustrated herein.

Another object of the present invention resides in the provision of toner and developer compositions wherein undesirable toner depositions and comets are avoided when such compositions are selected for electrophotographic, including xerographic imaging and printing processes.

In another object of the present invention there are provided toner and developer compositions that enable the substantial elimination of undesirable toner depositions on documents generated in electrostatographic imaging systems.

Moreover, another object of the present invention relates to the provision of toner and developer compositions wherein the pigments, such as magnetite, are permanently associated with the toner polymer, thus no undesirable toner deposits and comets are formed, or such deposits are substantially eliminated in electrophotographic imaging processes.

In another object of the present invention there are provided toner and developer compositions wherein the pigments, such as magnetite, are dispersed at acceptable levels, for example, of from about 30 to about 70 percent in the toner compositions, and the magnetite is permanently associated with the toner polymer thereby enabling the advantages as illustrated herein.

Furthermore, there is a need for processes for positively charged and negatively charged toner and developer compositions useful for the development of images present on positively or negatively charged imaging members.

Additionally, in still another object of the present invention there are provided methods for the development of images, including colored images with substantially no undesirable toner deposits thereon, or the presence of comets especially when blade cleaning is selected in electrostatographic imaging systems.

These and other objects of the present invention are accomplished by providing processes for developer compositions and toner compositions. More specifically, the present invention is directed to processes for the preparation of toner compositions comprised of polymer particles, pigment particles inclusive of magnetites, and optional additives which comprises flushing components, such as magnetite, into the toner enabling, for example, the pigment particles, such as magnetite, to be permanently associated with the polymer particles.

In one embodiment of the present invention, there is provided a process for the preparation of toner compositions which comprises forming an organic phase comprised of polymer and solvent, forming a aqueous phase comprised of water and pigment such as magnetite, and flushing the magnetite into the organic phase. Another embodiment of the present invention is directed to a process for the preparation of toner compositions which comprises forming an organic phase comprised of polymer and solvent, forming an aqueous phase comprised of water and magnetite, flushing the magnetite into the polymer present in the organic phase, removing the water and solvent by, for example, a vacuum whereby the magnetite is permanently associated with said polymer. Also, in another embodiment of the present invention there is provided a process for the preparation of toner compositions which comprises forming an organic phase by the mixing of a polymer and a solvent, forming a aqueous phase cake by mixing water and magnetite, flushing the magnetite into the polymer present in the organic phase, removing the water and solvent whereby the magnetite is permanently associated with said polymer, diluting the aforementioned formed toner comprised of polymer and magnetite, crushing the toner with, for example, a Sitz mill, and subsequently jetting and classifying said toner. Generally, the aforementioned toner product is of an average particle diameter of from about 5 to about 20 microns. Additives such as charge control agents, alkylenes in amounts of from about, for example, 1 to about 10 weight percent, including polypropylenes and polyethylenes, which alkylenes are of low molecular weight, that is less than or equal to about 20,000 and preferably about 7,000, including 660P commercially available from Sanyo Chemical, Inc. and the like, as illustrated herein can be added during the process. Also, metal salts of fatty acids, metal oxides, colloidal silicas, and the like as indicated herein can be added to the formed toner composition usually in an amount of from about 0.1 to about 3, and preferably from about 0.1 to about 1.0 percent by weight.

Flushing as indicated herein comprises, for example, in one embodiment the mixing in a blender of a water wetted magnetite cake with a solvent, such as toluene, and polymer such as styrene butadiene. The magnetite transfers from the water phase containing magnetite to the organic phase comprised of the polymer and an organic solvent providing the objectives of the present invention are achieved. Thereafter, the water is removed by, for example, decantation and the resulting flushed master batch comprised of magnetite and polymer can be diluted with additional polymer, and in some instances polymer and solvent. Subsequently, the solvent and any remaining water is removed by heat and vacuum. This ensures that there is permanent association of the pigment with the polymer, and excellent dispersion of the pigment, such as magnetite, in the polymer. Toner compositions can then be prepared from the resulting master batch, which is pulverized or crushed with a Sitz mill, for example, which master batch is comprised of magnetite and polymer by diluting (letting down) the batch with additional polymer resin and other optional components such as charge control additives, other polymers such as waxes including the low molecular weight alkylenes mentioned herein; and/or a second toner resin such as a crosslinked styrene methacrylate or a crosslinked styrene acrylate and preferably a crosslinked styrene butylmethacrylate. The master batch usually contains from about 10 to about 75 weight percent of pigment, such as magnetite, and from about 25 to about 90 weight percent of polymer, including polymers such as styrene acrylates, styrene methacrylates, styrene butadienes, polyesters, polyesters, Pliolites®, and other similar known toner polymers, reference for example U.S. Pat. No. 4,298,672, the disclosure of which is totally incorporated herein by reference. As additional polymers there can be selected the aforesaid polymers including styrene acrylates, styrene methacrylates, styrene butadienes, polyesters, Pliolites®, and the like, to enable the desired final magnetite concentration, for example, in a preferred embodiment of from about 10 to about 75 and preferably from about 15 to about 20 weight percent for two component developers, and from about 50 to about 75 percent by weight for single component developers. The final toner composition is then formulated by conventional methods such as placing the aforesaid components in a conventional melt mixing apparatus such as an extruder, a Banbury mixer and the like, subjecting the components to crushing using a Sitz mill, and thereafter jetting and classifying the toner composition. There usually results a toner composition with an average volume diameter of from about 5 to about 20 microns, and preferably from about 10 to about 14 microns, however, other diameters not specifically mentioned can be selected including those greater than 20 microns and less than 5 microns providing the objectives of the present invention are achievable.

The toner compositions obtained permit excellent dispersion of the magnetite or other pigments in the toner, for example, no significant amount of agglomerates comprised of primary particles, and there is constant physical contact between the pigment particles and the pigments such as magnetite. Also, the formed toner composition possesses the other advantages indicated herein including the avoidance of unwanted toner deposits on the imaging member, and substantial elimination of comets. One preferred toner composition obtained with the process of the present invention is comprised of about 16 weight percent of magnetite, 3 weight percent of carbon black particles, 1 percent by weight of the charge enhancing additive distearyl dimethyl ammonium methyl sulfate, and 80 percent by weight of a styrene butadiene resin polymer (91/9).

The formed toner compositions may contain as indicated herein in an amount of from about 0.1 to about 20, and preferably in an amount of from about 1 to about 5 weight percent, optional charge enhancing additives, particularly, for example, distearyl dimethyl ammonium methyl sulfate, reference U.S. Pat. No. 4,560,635, the disclosure of which is totally incorporated herein by reference, alkyl pyridinium halides, potassium tetraphenyl borate, TRH available from Hodogaya, orthophenyl carboxylic acids, and the like.

Developer compositions are formulated by, for example, mixing the toner compositions obtained with the process of the present invention and carrier particles. As preferred carrier components for the aforementioned compositions, there can be selected steel or ferrite materials, particularly with a polymeric coating thereover including the coatings as illustrated in U.S. Ser. No. 751,922, now abandoned, entitled Developer Composition with Specific Carrier Particles, the disclosure of which is totally incorporated herein by reference. One particularly preferred coating illustrated in the aforementioned copending application is comprised of a copolymer of vinyl chloride and trifluorochloroethylene with conductive substances dispersed in the polymeric coating inclusive of, for example, carbon black. One embodiment disclosed in the aforementioned copending application is a developer composition comprised of styrene butadiene copolymer resin particles, and charge enhancing additives selected from the group consisting of alkyl pyridinium halides, ammonium sulfates, and organic sulfate or sulfonate compositions; and carrier particles comprised of a core with a coating of vinyl copolymers, or vinyl homopolymers.

Illustrative specific examples of suitable polymers selected for the process of the present invention and present in various effective amounts such as, for example, from about 70 percent by weight to about 95 percent by weight, include polyesters, polyamides, epoxy resins, polyurethanes, polyolefins, vinyl resins and polymeric esterification products of a dicarboxylic acid and a diol comprising a diphenol. Various suitable vinyl resins may be selected as the toner resin including homopolymers or copolymers of two or more vinyl monomers. Typical vinyl monomeric units include styrene, p-chlorostyrene, vinyl naphthalene, unsaturated monoolefins such as ethylene, propylene, butylene, isobutylene and the like; vinyl halides such as vinyl chloride, vinyl bromide, vinyl fluoride, vinyl acetate, vinyl propionate, vinyl benzoate, and vinyl butyrate; vinyl esters such as esters of monocarboxylic acids including methyl acrylate, ethyl acrylate, n-butylacrylate, isobutyl acrylate, dodecyl acrylate, n-octyl acrylate, 2-chloroethyl acrylate, phenyl acrylate, methylalpha-chloroacrylate, methyl methacrylate, ethyl methacrylate, and butyl methacrylate; acrylonitrile, methacrylonitrile, acrylamide; vinyl ethers such as vinyl methyl ether, vinyl isobutyl ether, and vinyl ethyl ether; N-vinyl indole; N-vinyl pyrrolidone; styrene butadiene copolymers, especially styrene butadiene copolymers prepared by a suspension polymerization process, reference U.S. Pat. No. 4,558,108, the disclosure of which is totally incorporated herein by reference; Pliolites®; and mixtures thereof.

As one preferred polymer resin there can be selected the esterification products of a dicarboxylic acid and a diol comprising a diphenol, which components are illustrated in U.S. Pat. No. 3,590,000, the disclosure of which is totally incorporated herein by reference. Other preferred toner resins included styrene/methacrylate copolymers (especially 58/42), styrene/acrylate copolymers (especially 65/35), and styrene/butadiene copolymers, especially those as illustrated in the aforementioned patent; and styrene butadiene resins with high styrene content, that is exceeding from about 80 to 85 percent by weight of styrene, which resins are available as Pliolites® from Goodyear Chemical Company; polyester resins obtained from the reaction of bisphenol A and propylene oxide, followed by the reaction of the resulting product with fumaric acid; branched polyester resins resulting from the reaction of dimethylterephthalate, 1,3-butanediol, 1,2-propanediol and pentaerythritol; and the like.

Numerous well known suitable pigments can be selected as the colorant for the toner particles including, for example, carbon black, nigrosine dye, aniline blue, phthalocyanine derivatives, magnetites and mixtures thereof. This pigment, which is initially present in the water phase, is preferably comprised of magnetites, including those commercially available as Mapico Black which magnetite is present in the water phase and in the final toner composition in an amount of from about 10 percent by weight to about 70 percent by weight, and preferably in an amount of from about 10 percent by weight to about 30 percent by weight. Alternatively, there can be selected as pigment particles mixtures of carbon black or equivalent pigments and magnetites, which mixtures, for example, contain from about 6 percent to about 70 percent by weight of magnetite, and from about 2 percent to about 15 percent by weight of carbon black. Particularly preferred as pigments are mixtures of magnetites and carbon black, or magnetites as they enable, for example, images with no toner deposits, and comets as indicated herein for extended time periods exceeding the development of 500,000 images, which corresponds to about 2,000,000 imaging cycles for a panel containing four imaging members. When the pigment carbon black or other similar component other than magnetite is selected, it should be present in a sufficient amount to render the toner composition colored thereby permitting the formation of a clearly visible image. Generally, these pigment particles are present in amounts of from about 3 percent by weight to about 20 percent by weight based on the total weight of the toner composition, however, lesser or greater amounts of pigment particles can be selected providing the objectives of the present invention are achieved.

Also encompassed within the scope of the present invention is the preparation of colored toner compositions containing as pigments or colorants in addition to pigments such as magnetite, or mixtures of magnetite, and carbon black are magenta, cyan, and/or yellow particles, red, blue, brown, as well as mixtures thereof. More specifically, with regard to the generation of color images utilizing the toner and developer compositions obtained by the process of the present invention, illustrative examples of magenta materials that may be selected include, for example, 2,9-dimethyl-substituted quinacridone and anthraquinone dye identified in the Color Index as CI 60710, CI Dispersed Red 15, a diazo dye identified in the Color Index as CI 26050, CI Solvent Red 10, Lithol Scarlett, Hostaperm, and the like. Illustrative examples of cyan materials that may be used as pigments include copper tetra-4(octadecyl sulfonamido) phthalocyanine, X-copper phthalocyanine pigment listed in the Color Index as CI 74160, CI Pigment Blue, and Anthrathrene Blue identified in the Color Index as CI 69810, Special Blue X-2137, Sudan Blue, and the like; while illustrative examples of yellow pigments that may be selected include diarylide yellow 3,3-dichlorobenzidene acetoacetanilides, a monazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy aceto-acetanilide, Permanent Yellow FGL, and the like. These pigments are generally present in the toner composition in an amount of from about 2 weight percent to about 15 weight percent based on the weight of the toner resin particles.

Illustrative specified examples of optional charge enhancing additives present in various effective amounts, such as for example from about 0.1 to about 20, and preferably from about 1 to about 5 percent by weight, include as indicated herein alkyl pyridinium halides, such as cetyl pyridinium chlorides, reference U.S. Pat. No. 4,298,672, the disclosure of which is totally incorporated herein by reference; cetyl pyridinium tetrafluoroborates, quaternary ammonium sulfate, and sulfonate charge control agents as illustrated in U.S. Pat. No. 4,338,390, the disclosure of which is totally incorporated herein by reference; stearyl phenethyl dimethyl ammonium tosylates, reference U.S. Pat. No. 4,338,390, the disclosure of which is totally incorporated herein by reference; distearyl dimethyl ammonium methyl sulfate, reference U.S. Pat. No. 4,560,635, the disclosure of which is totally incorporated herein by reference; stearyl dimethyl hydrogen ammonium tosylate; and other known similar charge enhancing additives providing the objectives of the present invention are accomplished; and the like.

Examples of solvents selected in effective amounts of, for example, from about 5 to about 20, and preferably from about 5 to about 10 weight percent include organic and inorganic solvents such as toluene, xylene, halogenated materials such as trichloroethylene, and the like providing the objectives of the present invention are achieved. The primary purpose of the solvent is to soften the polymer.

With further respect to the process of the present invention, particularly the advantages achievable thereby, the deposited toner compositions on the imaging member can retain electrostatic charge independent of the exposure of the imaging member permitting it to undesirably attract toner particles which are then transferred to the final image copy yielding an unwanted image defect, that is for example a character may not appear that was present on the original. Accordingly, toner deposits are undesirable, particularly when more than one deposit results on the final image which is usually the situation with the prior art wherein, for example, hundreds of deposits can result with a length of from about 4 to about 5 millimeters, and a width of 0.5 millimeter as eventually these deposits will result in images of very poor resolution, unwanted background, and other undesirable copy quality characteristics including unacceptable edge definition.

Illustrative examples of carrier particles as indicated herein that can be selected for mixing with the toner compositions of the present invention include those particles that are capable of triboelectrically obtaining a charge of opposite polarity to that of the toner particles. Accordingly, the carrier particles of the present invention can be selected so as to be of a negative polarity thereby enabling the toner particles which are positively charged to adhere to and surround the carrier particles. Alternatively, there can be selected carrier particles with a positive polarity enabling toner compositions with a negative polarity. Illustrative examples of carrier particles that may be selected include granular zircon, granular silicon, glass, steel, nickel, iron, ferrites, silicon dioxide, and the like. Additionally, there can be selected as carrier particles nickel berry carriers as disclosed in U.S. Pat. No. 3,847,604, which carriers are comprised of nodular carrier beads of nickel characterized by surfaces of reoccurring recesses and protrusions thereby providing particles with a relatively large external area. Preferred carrier particles selected for the present invention are comprised of a magnetic, such as steel, core with a polymeric coating thereover several of which are illustrated, for example, in U.S. Ser. No. 751,922, now abandoned, relating to developer compositions with certain carrier particles, the disclosure of which is totally incorporated herein by reference. More specifically, there are illustrated in the aforementioned copending application carrier particles comprised of a core with a coating thereover of vinyl polymers, or vinyl homopolymers. Examples of specific carriers illustrated in the copending application, and particularly useful for the present invention are those comprised of a steel or ferrite core with a coating thereover of a vinyl chloride/trifluorochloroethylene copolymer, which coating contains therein conductive particles, such as carbon black. Other coatings include fluoropolymers, such as polyvinylidenefluoride resins, poly(chlorotrifluoroethylene), fluorinated ethylene and propylene copolymers, terpolymers of styrene/methylmethacrylate and a silane, such as triethoxy silane, reference U.S. Pat. Nos. 3,467,634 and 3,526,533, the disclosures of which are totally incorporated herein by reference; polytetrafluoroethylene, fluorine containing polyacrylates, and polymethacrylates; copolymers of vinyl chloride; and trichlorofluoroethylene; and other known coatings. There can also be selected as carriers components comprised of a core with a double polymer coating thereover, reference U.S. Ser. No. 793,042, now abandoned, entitled Developer Composition With Coated Carrier Particles, the disclosure of which is totally incorporated herein by reference. More specifically, there is detailed in this application a process for the preparation of carrier particles with substantially stable conductivity parameters which comprises (1)

mixing carrier cores with a polymer mixture comprising from about 10 to about 90 percent by weight of a first polymer, and from about 90 to about 10 percent by weight of a second polymer; (2) dry mixing the carrier core particles and the polymer mixture for a sufficient period of time enabling the polymer mixture to adhere to the carrier core particles; (3) heating the mixture of carrier core particles and polymer mixture to a temperature of between about 200° F. and about 550° F. whereby the polymer mixture melts and fuses to the carrier core particles; and (4) thereafter cooling the resulting coated carrier particles.

Also, while the diameter of the carrier particles can vary, generally they are of a diameter of from about 50 microns to about 1,000 microns, thus allowing these particles to possess sufficient density and inertia to avoid adherence to the electrostatic images during the development process. The carrier particles can be mixed with the toner particles in various suitable combinations, however, best results are obtained when about 1 to about 5 parts per toner to about 10 parts to about 200 parts by weight of carrier are mixed. Carrier coating weights can vary; generally, however, from about 0.1 to about 5 percent coating weight is selected.

The toner and developer compositions obtained with the process of the present invention may be selected for use in developing images in electrostatographic imaging systems containing therein, for example, conventional photoreceptors, such as selenium and selenium alloys. Also useful, especially wherein there is selected positively charged toner compositions, are layered photoresponsive devices comprised of transport layers and photogenerating layers, reference U.S. Pat. Nos. 4,265,990; 4,585,884; 4,584,253; and 4,563,408, the disclosures of which are totally incorporated herein by reference, and other similar layered photoresponsive devices. Examples of photogenerating layers include selenium, selenium alloys, trigonal selenium, metal phthalocyanines, metal free phthalocyanines and vanadyl phthalocyanines, while examples of charge transport layers include the aryl amines as disclosed in U.S. Pat. No. 4,265,990. Moreover, there can be selected as photoconductors hydrogenated amorphous silicon; and as photogenerating pigments squaraines, perylenes; and the like. Also, electroreceptors such as silicon carbide may be selected.

The toner and developer compositions prepared by the process of the present invention are particularly useful with electrostatographic imaging apparatuses containing a development zone situated between a charge transporting means and a metering charging means, which apparatus is illustrated in U.S. Pat. Nos. 4,394,429 and 4,368,970. More specifically, there is illustrated in the aforementioned '429 patent a self-agitated, two-component, insulative development process and apparatus wherein toner is made continuously available immediately adjacent to a flexible deflected imaging surface, and toner particles transfer from one layer of carrier particles to another layer of carrier particles in a development zone. In one embodiment, this is accomplished by bringing a transporting member, such as a development roller, and a tensioned deflected flexible imaging member into close proximity, that is a distance of from about 0.05 millimeter to about 1.5 millimeters, and preferably from about 0.4 millimeter to about 1.0 millimeter in the presence of a high electric field, and causing such members to move at relative speeds. There is illustrated in the aforementioned '970 patent an electrostatographic imaging apparatus comprised of an imaging means, a charging means, an exposure means, a development means, and a fixing means, the improvement residing in the development means comprising in operative relationship a tensioned deflected flexible imaging means; a transporting means; a development zone situated between the imaging means and the transporting means; the development zone containing therein electrically insulating magnetic carrier particles, means for causing the flexible imaging means to move at a speed of from about 5 cm/sec to about 50 cm/sec, means for causing the transporting means to move at a speed of from about 6 cm/sec to about 100 cm/sec, the means for imaging and the means for transporting moving at different speeds; and the means for imaging and the means for transporting having a distance therebetween of from about 0.05 millimeter to about 1.5 millimeters.

A second preferred developer composition prepared with the process of the present invention is comprised of a toner composition with styrene butadiene polymer particles (91/9), about 16 percent by weight of magnetite flushed therein and permanently associated therewith, and in contact with the polymer particles, about 3 percent by weight of carbon black, about 1.0 percent by weight of the charge enhancing additive distearyl dimethyl ammonium methyl sulfate, and as an external additive about 0.30 percent by weight of other additive such as colloidal silica particles, such as Aerosil R972, zinc stearate, or mixtures thereof.

The following examples are being submitted to further define various species of the present invention. These examples are intended to illustrate and not limit the scope of the present invention. Also, parts and percentages are by weight unless otherwise indicated.

With respect to image quality, a number of different imaging characteristics are associated therewith, thus high image quality includes, but is not limited to, for example, the absence of substantially no background deposits on the resulting image copy; acceptable edge definition; excellent solid area density; line width; and halftone reproduction; and further, the images were nongrainy as determined by visual observation.

EXAMPLE I

There was prepared a toner composition comprised of 80 percent by weight of a styrene butadiene resin with 91 percent by weight of styrene and 9 percent by weight of butadiene, 3 percent by weight of Regal 330® carbon black, 16 percent by weight of the magnetite Mapico Black, and 1 percent by weight of the charge enhancing additive distearyl dimethyl ammonium methyl sulfate by initially formulating two phases, that is a first phase comprised of the styrene butadiene polymer, magnetite, carbon black, charge additive, and toluene of about 120 milliliters, and a second phase comprised of a cake of water and Mapico Black magnetite with 60 weight percent of magnetite and 40 weight percent of water. Thereafter, the Mapico Black wet cake second phase was flushed into the first phase. Specifically, 120 milliliters of toluene were placed in a flusher comprised of a mixer equipped with a sigma blade and the temperature of the flusher was raised to 65° C. by heating with an oil bath. Subsequently, the first phase absent the toluene and containing 750 grams of the styrene butadiene was placed in the flusher and allowed to mix with the toluene present for 20 minutes at a flusher speed set at 6 whereby a melt formed. Subsequently, 1,254.2 grams of Mapico Black magnetite water wet cake with 50 weight percent of magnetite was added to the flusher melt in three portions of 627, 314, and 313.2 grams, respectively. With each addition of the wet cake, 20 milliliters of toluene was added and the water was separated by pouring. The mixture in the flusher was mixed for 35 minutes. After cooling to room temperature, the resulting product mixture was removed from the flusher and placed in a vacuum oven for 24 hours. Thereafter, the mixture was crushed with a Sitz mill for 5 minutes and the resulting components were further dried under a vacuum at 40° C. for an additional 60 hours. Subsequent to jetting for 5 minutes and classification for 3 minutes, there resulted the above toner composition with an average volume diameter of 11 microns, and a positive charge thereon of 18 microcoulombs per gram as determined by the standard Faraday cage apparatus. Classification was accomplished for the primary purpose of removing small toner particles of less than 5 and large particles greater than 30 microns average volume diameter.

Subsequently, there was prepared a developer composition by admixing the aforementioned formulated toner composition at a 3.5 percent toner concentration, that is 3.5 parts by weight of toner per 100 parts by weight of carrier, which carrier was comprised of a steel core with a coating thereover of a vinyl chloride trichlorofluoroethylene copolymer 0.6 weight percent coating weight with Regal 300® carbon black particles, about 20 percent dispersed therein.

Thereafter, the formulated developer composition was incorporated into an electrostatographic imaging device with a toner transporting means, a toner metering charging means, and a development zone as illustrated in U.S. Pat. No. 4,394,429; and wherein the imaging member is comprised of an aluminum supporting substrate, a photogenerating layer of trigonal selenium, and a charge transport layer thereover of the aryl amine N,N'-diphenyl-N,N'-bis(3-methylphenyl) 1,1'-biphenyl-4,4'-diamine, 50 percent by weight, dispersed in 50 percent by weight of the polycarbonate resin available as Makrolon®, reference U.S. Pat. No. 4,265,990, the disclosure of which is totally incorporated herein by reference. There resulted images of excellent quality, for example, with no background deposits, and no toner deposits were observed on the imaging member or the final image for 100,000 developed images.

The toner composition prepared contained an excellent dispersion of magnetite in the polymer and the magnetite was permanently associated with the styrene polymer and did not disassociate therefrom as evidenced, for example, by the absence of toner deposits and comets (the bulk of which is comprised of free magnetite) on the imaging member after prolonged use, that is 500,000 imaging cycles.

Other modifications of the present invention may occur to those skilled in the art subsequent to a review of the present application. The aforementioned modifications, including equivalents thereof are intended to be included within the scope of the present invention.

What is claimed is:

1. A process for the preparation of toner compositions consisting essentially of forming an organic phase by the mixing of a polymer and a solvent, forming an aqueous phase cake by mixing water and pigment, flushing the pigment into the polymer present in the organic phase, removing the water and solvent whereby the pigment is permanently associated with said polymer, diluting the aforementioned formed toner comprised of polymer and pigment with additional polymer and crushing the toner.

2. A process in accordance with claim 1 wherein dilution is accomplished with a polymer/magnetite mixture.

3. A process in accordance with claim 1 wherein dilution is accomplished by the addition of charge enhancing additives.

4. A process in accordance with claim 1 wherein dilution is accomplished by the addition of low molecular weight waxes.

5. A process in accordance with claim 1 wherein the polymer is present in an amount of from about 25 to about 90 weight percent.

6. A process in accordance with claim 1 wherein the pigment is magnetite present in an amount of from about 10 to about 75 percent by weight.

7. A process in accordance with claim 1 wherein the toner composition resulting is further processed by melt mixing followed by jetting and classification.

8. A process in accordance with claim 7 wherein there results a toner with an average volume diameter of from about 5 to about 20 microns.

9. A process in accordance with claim 1 wherein there is avoided the deposition of toner on the imaging member present in an electrographic imaging process.

10. A process in accordance with claim 1 wherein the pigment is magnetite present in an amount of from about 50 to about 70 weight percent.

11. A process in accordance with claim 2 wherein the mixture contains from about 10 to about 75 weight percent of magnetite and from about 25 to about 90 weight percent of polymer.

12. A process for the preparation of toner compositions consisting essentially of forming an organic phase by the mixing of a polymer and a solvent, forming an aqueous phase cake by mixing water and pigment, flushing the pigment into the polymer present in the organic phase, removing the water and solvent whereby the pigment is permanently associated with said polymer, diluting the aforementioned formed toner comprised of polymer and pigment, crushing the toner, and subsequently jetting and classifying said toner.

13. A process in accordance with claim 1 wherein flushing is accomplished at a temperature of from about 50 to about 80° C.

14. A process in accordance with claim 1 wherein there is added to the toner composition obtained charge enhancing additives.

15. A process in accordance with claim 14 wherein the charge additive is added in an amount of from about 0.1 to about 10 weight percent.

16. A process in accordance with claim 14 wherein the charge additive is selected from the group consisting of alkyl pyridinium halides, organic sulfonate and organic sulfate compositions, and distearyl dimethyl ammonium methyl sulfate.

17. A process in accordance with claim 1 wherein the pigment is comprised of the magnetite Mapico Black.

18. A process in accordance with claim 1 wherein there is added to the organic phase carbon black particles.

19. A process in accordance with claim 1 wherein there is added to the toner composition as external components colloidal silica particles, metal salts of fatty acids, metal oxides, or mixtures thereof.

20. A process in accordance with claim 19 wherein the metal oxides are aluminum oxide, titanium oxide, tin oxide, or silicon oxide.

21. A process in accordance with claim 1 wherein the polyester results from the condensation reaction of dimethylterephthalate, 1,2-propanediol, 1,3-butanedio, and pentaerythritol; or wherein the polyester results from the condensation reaction of dimethylterephthalate, 1,2-propanediol, diethylene glycol, and pentaerythritol.

22. A process in accordance with claim 1 wherein the styrene butadiene copolymer contains 91 percent by weight of styrene and 9 percent by weight of butadiene.

23. A process in accordance with claim 1 wherein there is selected a suspension polymerized styrene butadiene.

24. A process in accordance with claim 23 wherein flushing permits the effective dispersion of the pigment particles and thereby enables the pigment particles to be in contact with the toner resin.

25. A process in accordance with claim 24 wherein the pigment particles are comprised of magnetite.

26. A process in accordance with claim 24 wherein the pigment particle surface is surrounded by the toner polymer resin subsequent to flushing thereby assuring complete and intimate wetting of the pigment by the polymer and permanent association of the pigment with the polymer.

27. A process in accordance with claim 26 wherein the pigment is magnetite.

* * * * *